US007264188B2

(12) United States Patent
Anderson et al.

(10) Patent No.: US 7,264,188 B2
(45) Date of Patent: Sep. 4, 2007

(54) NOISE BAFFLE FOR FOOD WASTE DISPOSER

(75) Inventors: Scott W Anderson, Racine, WI (US); Steven P Hanson, Racine, WI (US)

(73) Assignee: Emerson Electric Co., St. Louis, MO (US)

( * ) Notice: Subject to any disclaimer, the term of this patent is extended or adjusted under 35 U.S.C. 154(b) by 0 days.

(21) Appl. No.: 11/164,585

(22) Filed: Nov. 29, 2005

(65) Prior Publication Data

US 2006/0278743 A1 Dec. 14, 2006

Related U.S. Application Data

(60) Provisional application No. 60/595,197, filed on Jun. 14, 2005.

(51) Int. Cl.
*B02C 23/36* (2006.01)

(52) U.S. Cl. ..... 241/46.01; 241/46.013

(58) Field of Classification Search ..... 241/46.01, 241/46.013, 46.014, 46.015, 46.016; 4/DIG. 4
See application file for complete search history.

(56) References Cited

U.S. PATENT DOCUMENTS

| | | | | |
|---|---|---|---|---|
| 2,896,866 | A * | 7/1959 | Hyde | 241/46.016 |
| 3,432,108 | A * | 3/1969 | Enright | 241/46.016 |
| 3,524,596 | A * | 8/1970 | Smith | 241/46.016 |
| 6,719,228 | B2 | 4/2004 | Berger et al. | |
| 7,100,850 | B2 | 9/2006 | Farmerie | |
| 2004/0195409 | A1 * | 10/2004 | Berger et al. | 241/46.015 |

FOREIGN PATENT DOCUMENTS

WO 02062478 A 8/2002

* cited by examiner

*Primary Examiner*—Faye Francis
(74) *Attorney, Agent, or Firm*—Harness, Dickey & Pierce P.L.C.

(57) ABSTRACT

A baffle for a food waste disposer includes a pleated portion with pleats that define an opening therethrough for equalizing pressure in the food waste disposer above and below the baffle. Water passing over the opening creates a venturi to pull air out of the high-pressure environment inside the grinding portion of the food waste disposer.

18 Claims, 5 Drawing Sheets

FIG. 5
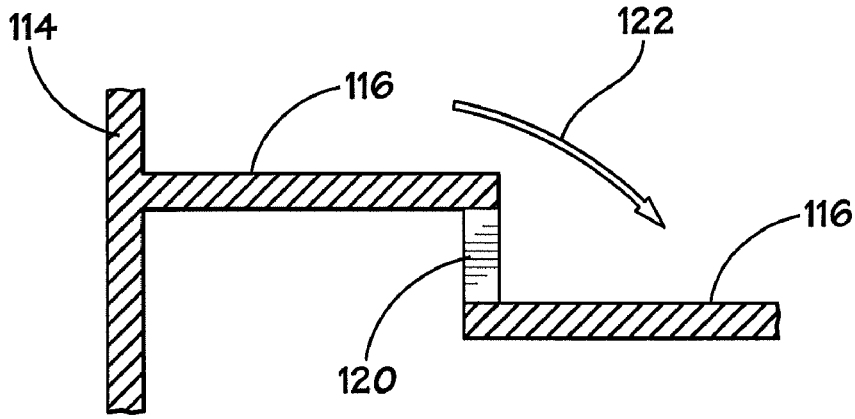
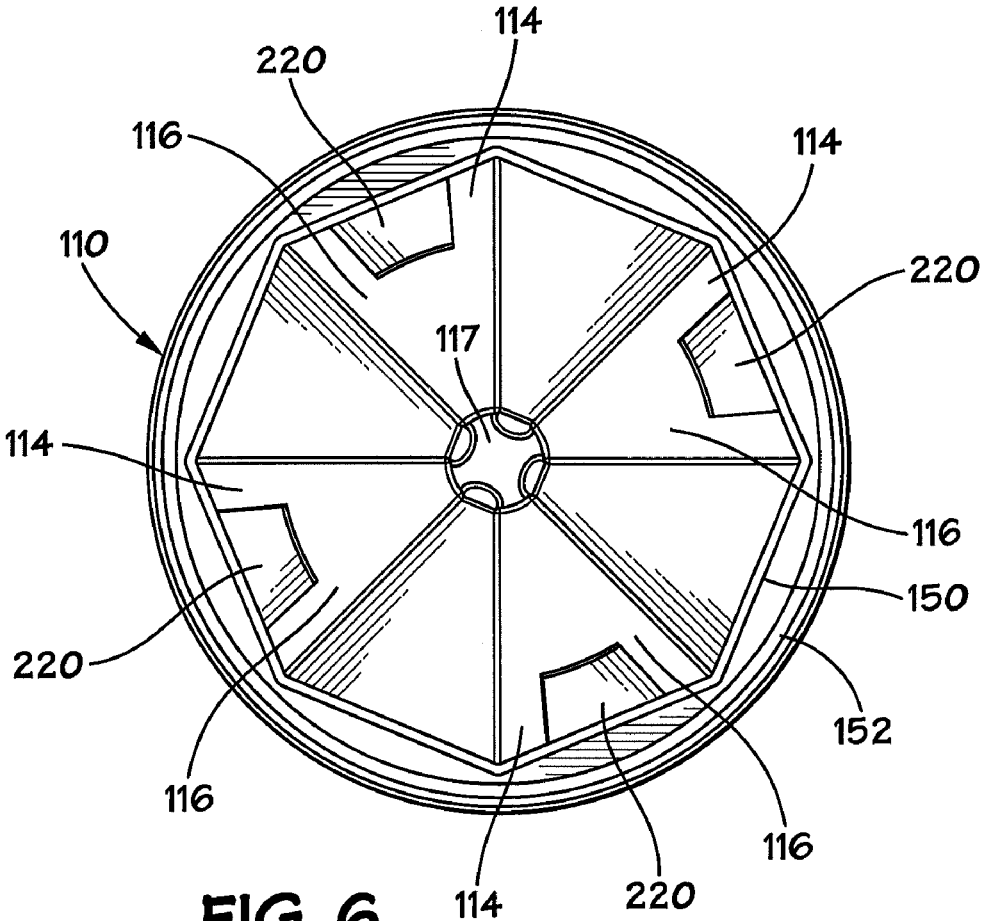
FIG. 6

FIG. 7
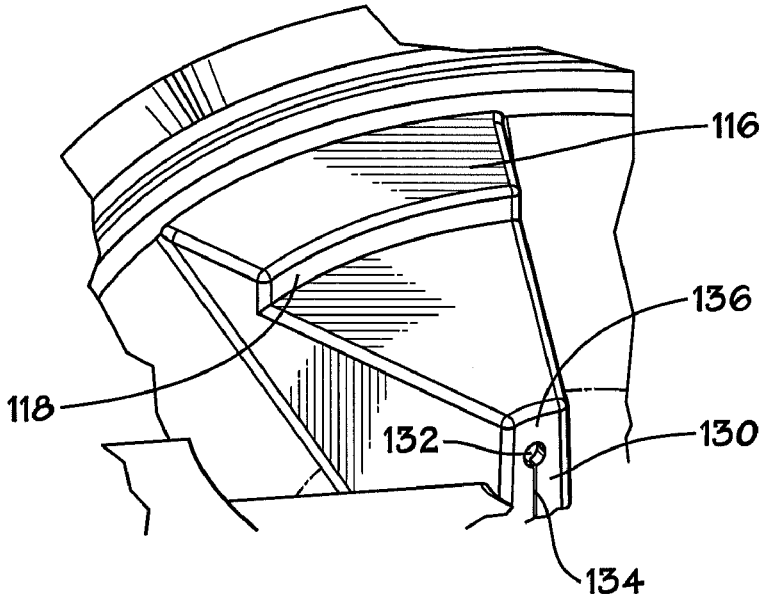
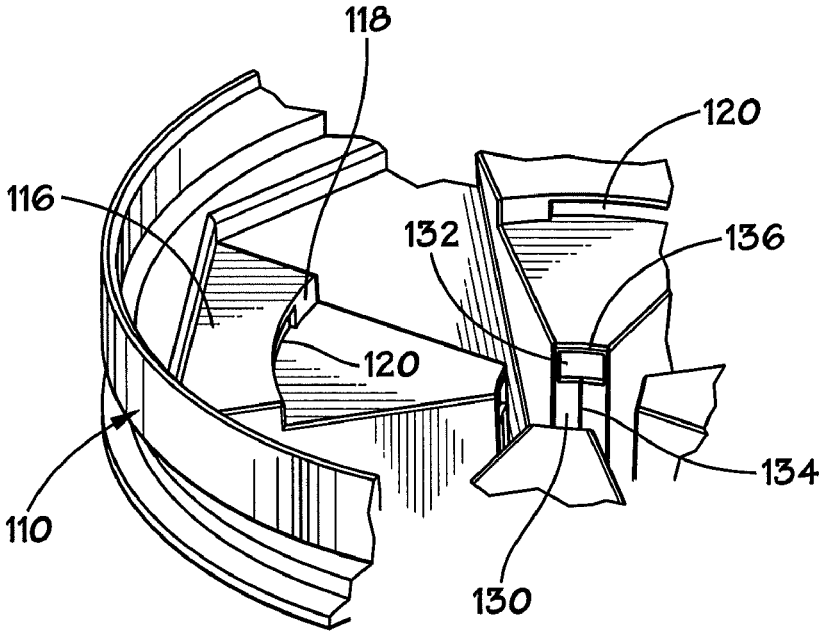
FIG. 8

NOISE BAFFLE FOR FOOD WASTE DISPOSER

CROSS-REFERENCE TO RELATED APPLICATION

This application is a non-provisional application of U.S. Provisional Patent Application Ser. No. 60/595,197, filed on Jun. 14, 2005, which is incorporated by reference.

BACKGROUND

The present disclosure relates generally to food waste disposers.

Food waste disposers are used to comminute food scraps into particles small enough to safely pass through household drain plumbing. A conventional disposer includes a food conveying section, a motor section, and a grinding mechanism disposed between the food conveying section and the motor section. The food conveying section includes a housing that forms an inlet connected to a sink flange for receiving food waste and water. The food conveying section conveys the food waste to the grinding mechanism, and the motor section includes a motor imparting rotational movement to a motor shaft to operate the grinding mechanism.

Conventional food waste disposers produce noise during operation. This is due, in part, by the operation of the motor as well as by the food impacting against the disposer body and grind components. To reduce noise, it has been known to place an insulating cover around the exterior housing of the disposer. An exterior cover, however, does not prevent noise from traveling up through a drain opening of a sink where it can easily be heard by the user of the food waste disposer.

It has also been known to use a baffle between the disposer inlet and the drain opening. One function of the baffle is to keep food waste from getting "kicked back" up through the drain opening when the disposer is operating. The baffle reduces only a portion of the noise from the disposer, due in part to the fact that a typical baffle has an opening that allows noise to directly pass up through the drain opening. Additionally, water flowing into the disposer from the user's faucet, which normally flows during the operation of the disposer, does not act to adequately fill the spaces left by these openings. Instead, water runs almost unencumbered through the baffle and down into the disposer, and hence the water does not act to further shield noise from emanating into the sink.

U.S. patent application Ser. No. 09/997,678, entitled "Food Waste Disposer Having Mechanism and Method For Creating a Water Baffle to Reduce Noise," filed Nov. 29, 2001 by inventor Joseph G. Farmerie, and claiming priority to provisional patent application Ser. No. 60/253,804, filed Nov. 29, 2000, both of which are assigned to the assignee of the present application and which are incorporated herein by reference in their entireties, discloses a method for creating a water baffle to block the noise of the grinding mechanism.

Key elements for the use of a water baffle depend on the water flow rate through the baffle, the surface tension of the water passing through the baffle and whether or not the disposer is vented. Too little water may not overflow the baffle adequately to prevent sound emission. Too much water may back-up the baffle causing a nuisance. The surface tension of the water influences how easily the water may flow though the baffle. Too little surface tension may allow even high flow rates of water to pass through the baffle and not adequately control noise emission. If the disposer is not vented, it may back-up the water in the baffle even at low flow rates causing a nuisance. If the disposer is vented, it still may cause the water, even at high flow rates, to pass through the baffle without adequately preventing noise emission.

The present application addresses shortcomings associated with the prior art.

SUMMARY

A baffle for a food waste disposer includes a pleated portion defining a plurality of pleats. At least one of the pleats defines a vent opening therethrough for equalizing pressure in the food waste disposer above and below the baffle. In some embodiments, each of the pleats defines the vent opening. In other exemplary embodiments, alternate pleats define the vent openings.

In accordance with certain aspects of the disclosure, the pleats include a top surface that defines a stepped portion including a vertical surface. The vent opening is defined in this vertical surface. In accordance with other aspects, the top surface of the pleats are flat, with the vent openings defined in the flat top surface. The vent openings may be molded into the top surface such that they are normally closed, where they open in response to pressure on top of the pleat.

The pleated portion further defines a central opening, and a vertical surface of at least one pleat proximate the central opening defines a keyhole slot therein. The keyhole slot typically includes a hole having a slit extending therefrom. Each of the vertical surfaces proximate the central opening defines a keyhole slot in some embodiments.

BRIEF DESCRIPTION OF THE DRAWINGS

Other objects and advantages of the invention will become apparent upon reading the following detailed description and upon reference to the drawings in which:

FIG. 5 is a partial section view of the baffle shown in FIGS. 2 and 3.

FIG. 6 is a top view of another exemplary baffle in accordance with certain teachings of the present disclosure.

FIGS. 7-9 are close-up views of exemplary baffle pleats.

Figure 1:
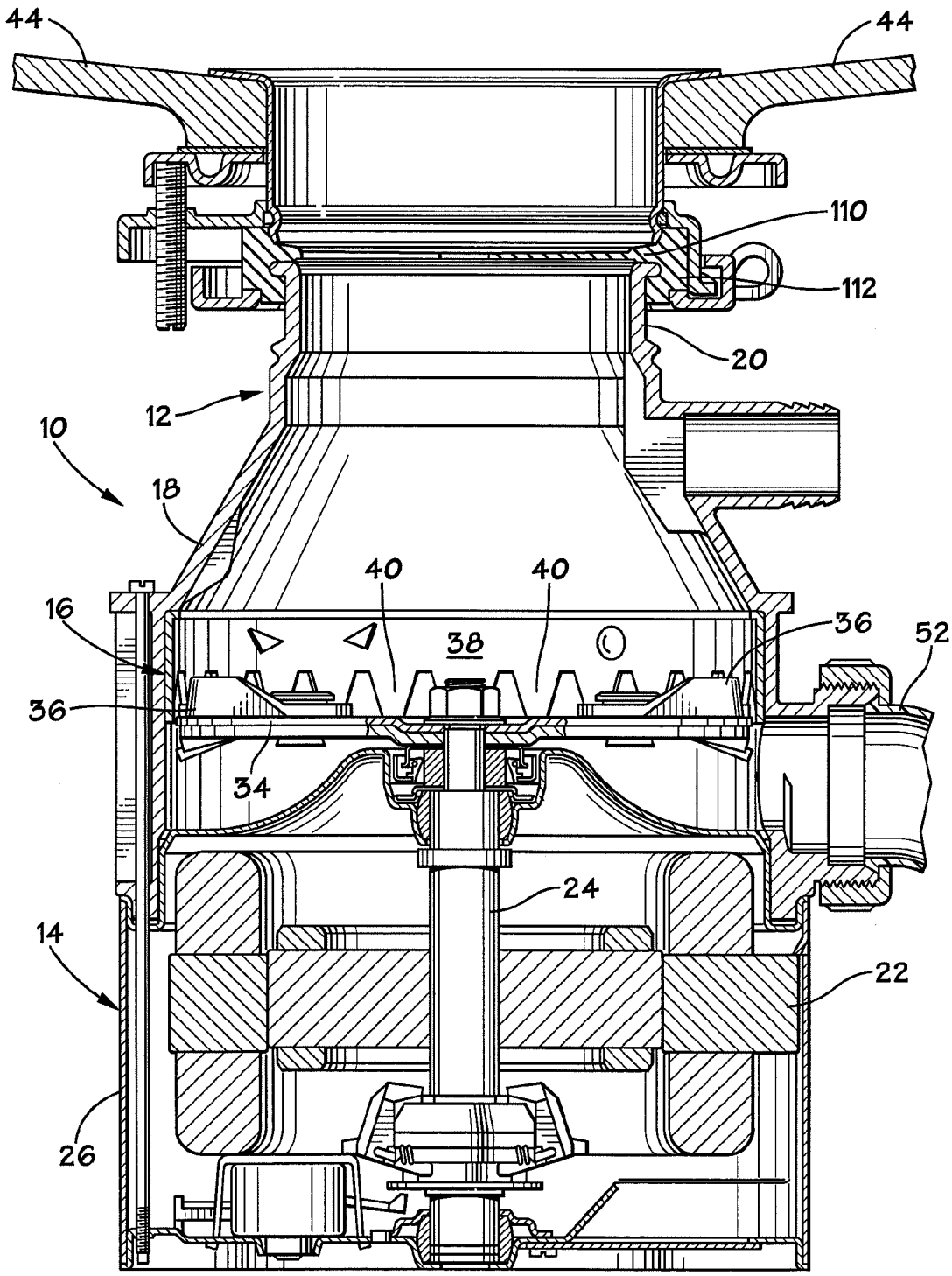
FIG. 1 is a sectional view illustrating portions of an exemplary food waste disposer system in accordance with the present disclosure.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention.

DETAILED DESCRIPTION

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

FIG. 1 illustrates portions of a food waste disposer 10 in accordance with certain teachings of the present disclosure. The food waste disposer 10 mounts to a sink 44 by any of a number of methods and techniques known in the art. The disposer 10 includes an upper food conveying section 12, a lower motor section 14, and a central grinding section 16 disposed between the food conveying section 12 and the motor section 14. The food conveying section 12 includes a housing 18 that forms an inlet 20 at its upper end for receiving food waste. The inlet 20 is connected to a sink flange 42. The food conveying section 12 conveys the food waste to the central grinding section 16. The motor section 14 includes a motor 22 imparting rotational movement to a motor shaft 24. The motor 22 is enclosed within a motor housing 26. The grinding section 16 includes a grinding mechanism having lugs 36, a rotating plate 34, and a stationary shredder ring 38.

In the operation of the food waste disposer, the food waste delivered by the food conveying section 12 to the grinding section 16 is forced by the lugs 36 against teeth 40 of the shredder ring 38. The edges of the teeth 40 grind the food waste into particulate matter sufficiently small to pass from above the grinding plate 34 to below the grinding plate 34 via gaps between the teeth 40 outside the periphery of the plate 34. Due to gravity and water, the particulate matter that passes through the gaps between the teeth 40, along with water injected into the disposer, is discharged through a discharge outlet 52.

Figure 2:
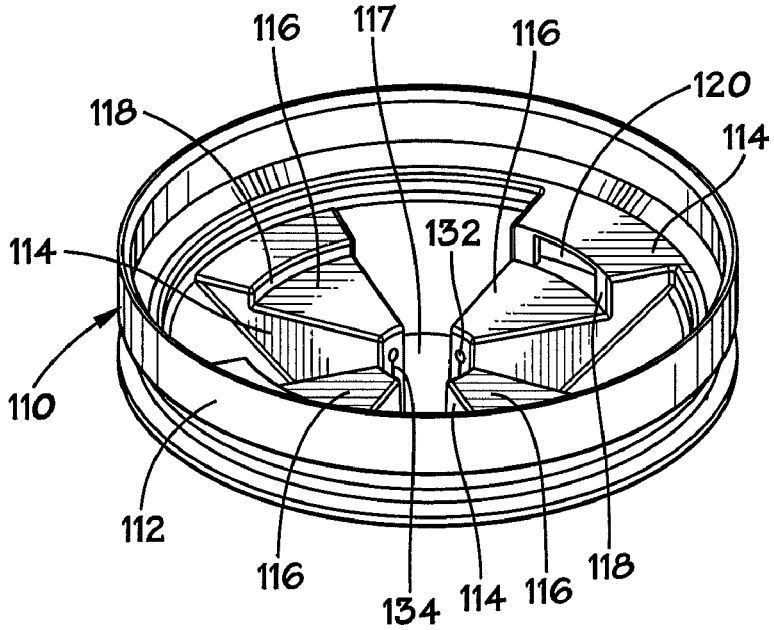
FIG. 2 is a top perspective view of an exemplary baffle in accordance with certain teachings of the present disclosure.
Figure 3:
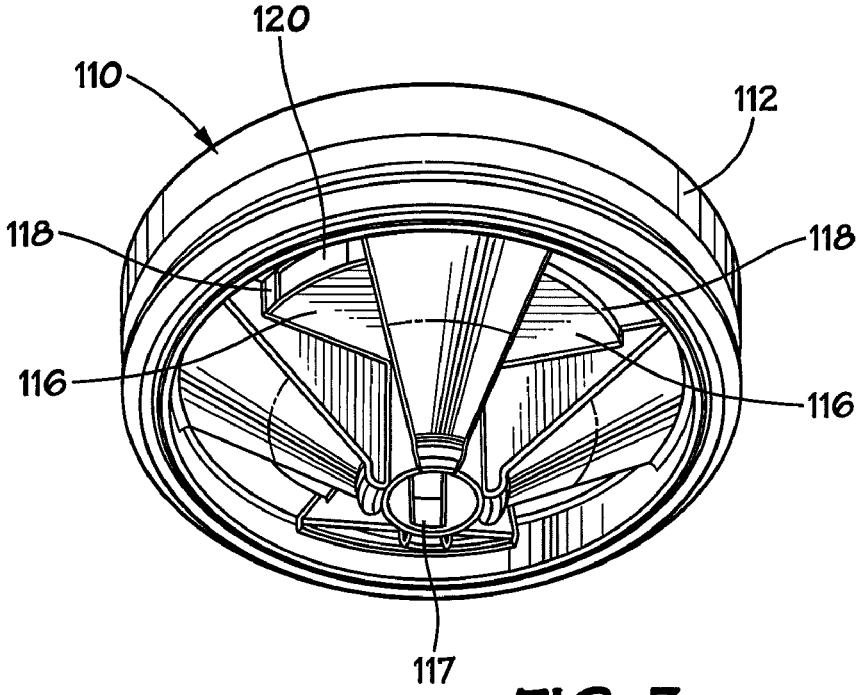
FIG. 3 is a bottom perspective view of the baffle shown in FIG. 2.

The inlet 20 of the food conveying section 12 includes a baffle device 110, an embodiment of which is shown in FIGS. 2 and 3. Among other things, the baffle 110 functions to create a sound barrier, holding a volume of water to reduce noise emitted from the disposer. The baffle 110 has an outer seal portion 112 and a pleated portion having a plurality of pleats 114. The outer seal portion 112 provides a seal for the inlet portion 12 of the disposer 10. The pleats 114 define a plurality of corresponding top surfaces 116. In the embodiment illustrated in FIGS. 2 and 3, the pleats 114 further define stepped portions, wherein surfaces 118 are generally oriented vertically—generally perpendicular to the top surface 116.

Figure 4:
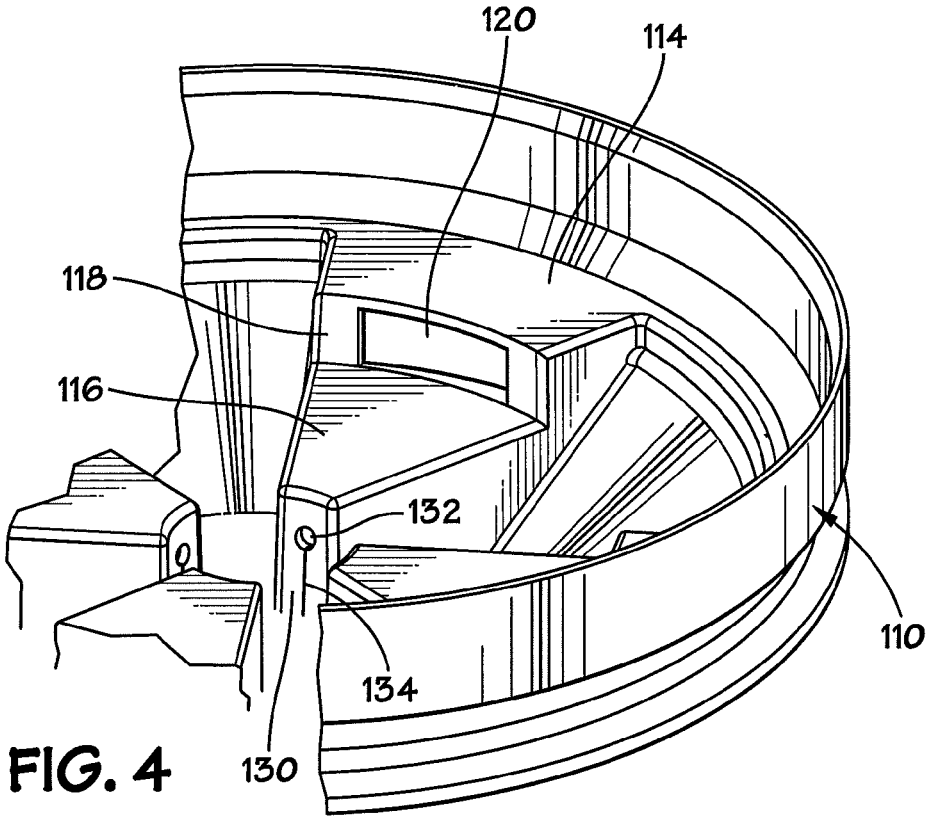
FIG. 4 is a close-up perspective view of a portion of the baffle shown in FIGS. 2 and 3.

At least some of the surfaces 118 define vent openings 120 extending therethrough. In the embodiment illustrated in FIGS. 2 and 3, alternating, or every-other vertical surface 118 defines a vent opening 120 therethrough. In other embodiments, each surface 118 may define an opening 120. FIGS. 4 and 5 are close-up perspective and partial section views, respectively, showing a top surface 116 and the vent opening 120 extending through the surface 118. Water flow is indicated by an arrow 122 in FIG. 5. The vertical drop of the water over the pleat vents 120 creates a waterfall effect that promotes the pulling of the air from the high pressure food conveying and grinding sections 18,16 to the low pressure ambient above the baffle 110, thus promoting the high pressure air to vent. Further, rotation or swirling of water inside the baffle 110 creates a similar effect as the water passes by the vent openings 120. Moreover, the waterfall effect promotes cavitation, or turbulence, in the water, which further promotes venting from high to low-pressure areas and reduces surface tension. The venturi feature primarily addresses a normally unvented grinding section 16 and prevents the nuisance backup of water.

In the embodiment shown in FIGS. 2-5, the openings 120 are fixed—they are openings molded into the baffle. In another embodiment shown in FIG. 6, the vent openings are flaps 220 molded into the surfaces 116 of the pleats 114 in a closed position so they are normally closed. Thus, when the baffle 110 is at rest or when it is not being used and no water is running into the food waste disposer through the sink flange and baffle, the flaps 220 are closed. The top surface of the vent flaps 220 is flat or parallel with the top surface 116 of the pleat 114.

When food waste and or water is put into the baffle central opening 117, it pushes down on the pleat top surface 116. This allows the vent flaps 220 to pop up, or move in the opposite direction from the top surface 116, thus opening the vent 220 to let air out of the food waste disposer and equalizing the pressure between the outside and inside of the disposer. This keeps water from backing up into the sink.

In the embodiment shown in FIG. 6, the top pleat surfaces 116 are flat, unlike the embodiment shown in FIG. 2 in which the top surface 116 defines the stepped portion 118. The flat top surface 116 helps to minimize the resistance to flexing or bending of the pleats under load, making it easier for the water to open the baffle and vents. The embodiment shown in FIG. 6 further has the top surfaces 116 of the baffle pleats hinged from a peripheral octagonal membrane 150 instead of the peripheral round membrane 152 to make opening of the baffle easier. The octagonal membrane 150 can also be used with the embodiment shown in FIGS. 2 and 3.

Figure 9:
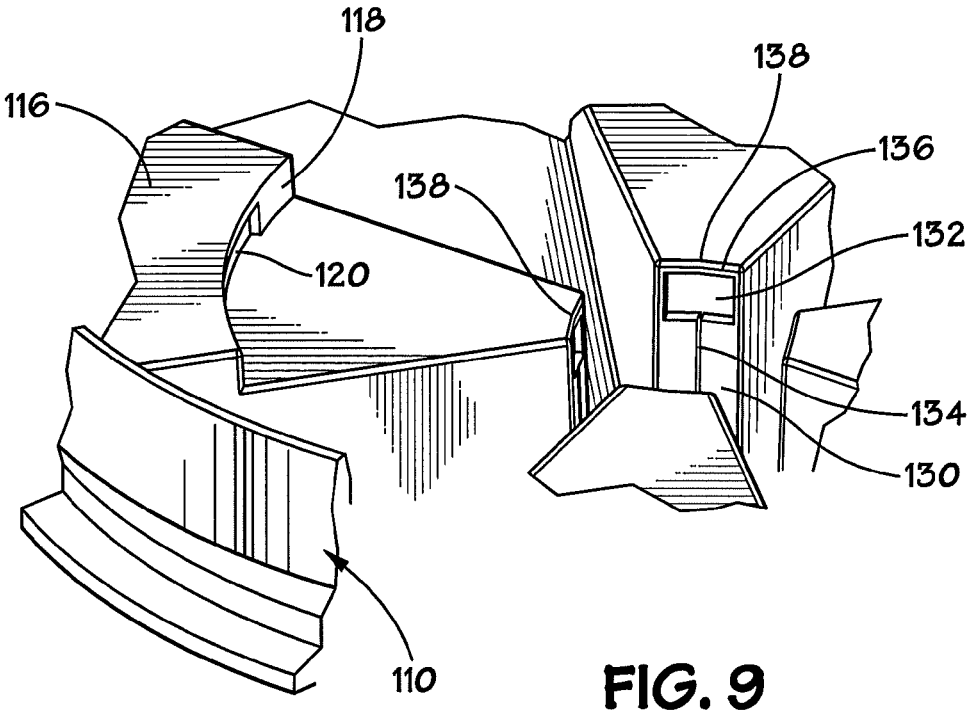

The pleats 114 of the baffle 110 further define a plurality of vertical faces 130 proximate the central opening 117. FIGS. 7-9 are close up views of exemplary pleats 114. The vertical faces define a "keyhole slot"—an opening 132 with a slit 134 below—on the vertical face 130 that also acts like a venturi device near the top of the pleat 114. The slit 134 in the face 130 below the keyhole 132 allows water to flow at a controlled rate through the baffle. As the top surface 116 is pushed down, the slit 134 opens more to allow increased water flow. In the illustrated embodiments, each of the pleats includes the keyhole 132 and slot 134, though in other embodiments, not all of the pleats may define these openings. For example, alternate pleats could define the keyhole 132 and slot 134.

The beam of material 136 immediately above the opening 132 prevents inversion of the pleats, which could cause a permanent misshaping of the pleats in that they may not return to their intended position if stretched beyond a certain point when food waste is passed through the baffle. The beam of material 136 further controls the spring rate of the pleats in the baffle, controlling how closed or open the pleats and slits 134 are to control the flow rate of water though the baffle. This, in turn, controls the volume of sound-muffling water barrier above the baffle 110. The beam 136 also mitigates creep over time so that the baffle 110 performs as intended over a greater period of time in use.

The keyhole slot 132, 134 primarily addresses low flow rates or when the water may have a low surface tension, such as when detergent is in the water. The combination of the vent openings 120 and the keyhole slot 132, 134 allows for a single baffle to actively optimize to varying flow rates and surface tension conditions found to be common in a household kitchen application.

In some embodiments, such as the embodiment illustrated in FIG. 9, the baffle 110 utilizes a geometry near the center or iris of the baffle in which the vertical face 130 of the pleats defines a crease 138, rather than being blunt. When the baffle 110 is pushed open, the slit 134 in the crease 138 gives minimal resistance to opening or flexing downward and opens by the pressure or weight of the water and or food waste.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed is:

1. A baffle for a food waste disposer, comprising:

a pleated portion having a plurality of pleats;

at least one of the pleats having a stepped portion including a vertical surface, the vertical surface having a vent opening therethrough for equalizing pressure in the food waste disposer above and below the baffle.

2. The baffle of claim 1, wherein the pleats include respective stepped portions having respective vertical surfaces having respective vent openings therethrough.

3. The baffle of claim 1, wherein alternate pleats include respective stepped portions having respective vertical surfaces having respective vent openings therethrough.

4. A baffle for a food waste disposer, comprising:

a pleated portion having a plurality of pleats;

at least one of the pleats having a vent opening therethrough for equalizing pressure in the food waste disposer above and below the baffle;

wherein the pleated portion has a central opening, and wherein a vertical surface of at least one pleat proximate the central opening has a keyhole slot therein.

5. The baffle of claim 4, wherein the pleats include respective vertical surfaces proximate the central opening having respective keyhole slots therein.

6. The baffle of claim 4, wherein the keyhole slot includes a hole having a slit extending therefrom.

7. The baffle of claim 4, wherein the vertical surface proximate the central opening has a vertical crease.

8. A baffle for a food waste disposer, comprising:

a pleated portion having a plurality of pleats;

at least one of the pleats having a top surface having a vent opening therethrough for equalizing pressure in the food waste disposer above and below the baffle; and wherein the vent opening comprises a flap molded into the top surface in a normally closed position.

9. The baffle of claim 8, wherein the flap opens in response to pressure on the top of the pleat.

10. A food waste disposer, comprising:

a food conveying section defining an inlet;

a grinding section having a grinding mechanism for grinding food waste received from the food conveying section;

a motor operably connected to the grinding mechanism to drive the grinding mechanism; and a baffle received by the inlet of the food conveying section, the baffle including a pleated portion having a plurality of pleats, at least one of the pleats having a stepped portion having a vertical surface, the vertical surface having a vent opening therethrough for equalizing pressure in the food waste disposer above and below the baffle.

11. The food waste disposer of claim 10, wherein the pleats include respective stepped portions having respective vertical surfaces having respective vent openings therethrough.

12. The food waste disposer of claim 10, wherein alternate pleats include respective stepped portions having respective vertical surfaces having respective vent openings therethrough.

13. A food waste disposer, comprising:

a food conveying section defining an inlet;

a grinding section having a grinding mechanism for grinding food waste received from the food conveying section;

a motor operably connected to the grinding mechanism to drive the grinding mechanism; and a baffle received by the inlet of the food conveying section, the baffle including a pleated portion having a plurality of pleats, at least one of the pleats having a vent opening therethrough for equalizing pressure in the food waste disposer above and below the baffle;

wherein the pleated portion has a central opening, and wherein a vertical surface of at least one pleat proximate the central opening has a keyhole slot therein.

14. The food waste disposer of claim 13, wherein the pleats include respective vertical surfaces proximate the central opening having respective keyhole slots therein.

15. The food waste disposer of claim 13, wherein the keyhole slot includes a hole having a slit extending therefrom.

16. The food waste disposer of claim 13, wherein the vertical surface proximate the central opening has a vertical crease.

17. A food waste disposer, comprising:

a food conveying section defining an inlet;

a grinding section having a grinding mechanism for grinding food waste received from the food conveying section;

a motor operably connected to the grinding mechanism to drive the grinding mechanism; and a baffle received by the inlet of the food conveying section, the baffle including a pleated portion having a plurality of pleats, at least one of the pleats having a top surface having a vent opening therethrough for equalizing pressure in the food waste disposer above and below the baffle;

wherein the vent opening comprises a flap molded into the top surface in a normally closed position.

18. The food waste disposer of claim 17, wherein the opening opens in response to pressure on the top of the pleat.

* * * * *